US008460069B2

(12) United States Patent
Annaka

(10) Patent No.: US 8,460,069 B2
(45) Date of Patent: Jun. 11, 2013

(54) LENS HOLDER

(75) Inventor: Satoshi Annaka, Tokyo (JP)

(73) Assignee: Hoya Corporation, Tokyo (JP)

( * ) Notice: Subject to any disclaimer, the term of this patent is extended or adjusted under 35 U.S.C. 154(b) by 709 days.

(21) Appl. No.: 12/532,995

(22) PCT Filed: Mar. 24, 2008

(86) PCT No.: PCT/JP2008/055393
§ 371 (c)(1),
(2), (4) Date: Sep. 24, 2009

(87) PCT Pub. No.: WO2008/117768
PCT Pub. Date: Oct. 2, 2008

(65) Prior Publication Data

US 2010/0112915 A1 May 6, 2010

(30) Foreign Application Priority Data

Mar. 26, 2007 (JP) ..... 2007-080021

(51) Int. Cl.
*B24B 13/005* (2006.01)

(52) U.S. Cl.
USPC ..... 451/384; 451/390

(58) Field of Classification Search
USPC ..... 451/384, 285–290, 390
See application file for complete search history.

(56) References Cited

U.S. PATENT DOCUMENTS

| | | | | |
|---|---|---|---|---|
| 2,395,700 | A * | 2/1946 | Walker | 451/390 |
| 5,291,692 | A * | 3/1994 | Takahashi et al. | 451/388 |
| 5,357,716 | A * | 10/1994 | Kishida et al. | 451/390 |
| 6,641,466 | B2 * | 11/2003 | Wallendorf et al. | 451/285 |
| 6,984,161 | B2 * | 1/2006 | Suzuki et al. | 451/5 |
| 7,195,538 | B2 * | 3/2007 | Tanaka | 451/5 |
| 7,309,278 | B2 * | 12/2007 | Shibata | 451/384 |
| 7,578,725 | B2 * | 8/2009 | Igarashi et al. | 451/41 |
| 2002/0149862 | A1 * | 10/2002 | Wallendorf et al. | 359/808 |
| 2003/0143936 | A1 * | 7/2003 | Igarashi et al. | 451/390 |
| 2007/0004317 | A1 * | 1/2007 | Tanaka | 451/5 |

FOREIGN PATENT DOCUMENTS

| | | | |
|---|---|---|---|
| EP | 1 243 381 | A2 | 9/2002 |
| JP | 6-024852 | U | 4/1994 |
| JP | 2001-047347 | A | 2/2001 |
| JP | 2002-370146 | A | 12/2002 |
| JP | 2005-254391 | A | 9/2005 |
| JP | 2005-271203 | A | 10/2005 |
| JP | 2006-181710 | A | 7/2006 |
| JP | 2006-305703 | A | 11/2006 |
| JP | 2006-346861 | A | 12/2006 |

* cited by examiner

*Primary Examiner* — Maurina Rachuba
(74) *Attorney, Agent, or Firm* — Blakely, Sokoloff, Taylor & Zafman

(57) ABSTRACT

A lens holder (8) includes a metal holder main body (12) and an elastic member (14) which holds the processing center portion (13) of a processing target lens (7). The holder main body (12) has a fitting hole (20) formed at a front surface center. The elastic member (14) includes a fitting shaft portion (14A) to be slidably fitted in the fitting hole (20), and a lens holding portion (14B) integrally provided to the fitting shaft portion (14A). The front surface of the lens holding portion (14B) forms a lens holding surface (24) which holds the processing target lens (7). Before holding the processing target lens (7), a suitable gap (g) is formed between the front surface (18) of the holder main body (12) and the lens holding surface (24). When the lens holding surface (24) is urged against the processing target lens (7), the lens holding portion (14B) elastically deforms toward the rear surface and is urged against the front surface (18) of the holder main body (12).

3 Claims, 4 Drawing Sheets

LENS HOLDER

This is a non-provisional application claiming the benefit of International application number PCT/JP2008/055393 filed Mar. 24, 2008.

TECHNICAL FIELD

The present invention relates to a lens holder used in edging a spectacle lens.

BACKGROUND ART

A spectacle lens edging apparatus generally includes a lens holding shaft and processing tool rotating shaft. An uncut round lens (to be also referred to as a processing target lens hereinafter) is mounted on the lens holding shaft through processing jig tools (a lens holder and lens retainer). A processing tool such as a grinding wheel attached to the processing tool rotating shaft processes the circumferential surface of the processing target lens, thus forming the lens into an edged lens shape complying with the frame shape of the spectacle frame. The lens holding shaft has first and second lens holding shafts arranged coaxially. The lens holder and lens retainer respectively attached to the opposing end faces of the first and second lens holding shafts sandwich the processing center portion of the processing target lens.

As a lens holder used in such an edging apparatus, for example, lens holders disclosed in, e.g., Japanese Utility Model Laid-Open No. 6-24852 and Japanese Patent Laid-Open Nos. 2001-47347 and 2005-271203 are known.

The lens holder described in Japanese Utility Model Laid-Open No. 6-24852 includes a clamp shaft attached to a lens holding shaft, and an elastic seal for holding the convex optical surface of a processing target lens. Sawteeth are formed on the seal attaching surface of the clamp shaft and caused to bite into the elastic seal, so that axial deviation of the processing target lens caused by the processing resistance generated during edging is prevented.

In the lens holder described in Japanese Patent Laid-Open No. 2001-47347, small recesses and projections are formed on a lens holding surface having a convex spherical shape which is to come into tight contact with the convex optical surface of a processing target lens, in the same manner as in the lens holder described in Japanese Utility Model Laid-Open No. 6-24852 mentioned above, in order to increase the tight connecting force with respect to an adhesive pad. The small recesses and projections have V-shaped sections in each of which the wall surfaces on the front and rear sides in the rotational direction are formed of surfaces inclined at almost the same angle. With this lens holder, since the adhesive pad evenly comes into tight contact with the two slopes of each of the small recesses and projections, the contact area enlarges to increase the lens holding force. Since the adhesive pad evenly comes into tight contact with the two slopes, no extra rotating force is generated in the adhesive pad. Thus, axial deviation of the processing target lens can be prevented.

The lens holder described in Japanese Patent Laid-Open No. 2005-271203 also includes teeth having V-shaped cross sections, in the same manner as the lens holder described in Japanese Patent Laid-Open No. 2001-47347 mentioned above.

DISCLOSURE OF INVENTION

Problem to be Solved by the Invention

In each of the above conventional lens holders described above, however, a thin sheet-like elastic seal is fixed with an adhesive. If the curvature of the lens holding surface of the lens holder is different from the lens curve of the processing target lens, the contact area of the processing target lens with the elastic sheet is small and accordingly the lens holding force is small. The processing target lens may easily deviate axially due to the processing resistance generated in edging. In view of this, development of a lens holder is requested which can hold a processing target lens stably and reliably so that the processing target lens will not axially deviate during edging.

The present invention has been made to solve the above problem and meet the above request, and has as its object to provide a lens holder which can obtain a large lens holding force and can accordingly hold a lens reliably, so that a lens will not axially deviate during processing.

Means of Solution to the Problem

In order to achieve the above object, according to the present invention, there is provided a lens holder which holds a processing center portion of one optical surface of a processing target lens and is mounted on a lens holding shaft of an edging apparatus, the lens holder comprising a metal holder main body and an elastic member which is detachably attached to the holder main body and holds the processing center portion of the processing target lens, the holder main body having a fitting hole formed at a center of a front surface, and the elastic member including a fitting shaft portion to be slidably fitted in the fitting hole, and a lens holding portion integrally provided with the fitting shaft portion, and the lens holding portion having a rear surface which forms a gap with the front surface, such that a vicinity of a connecting portion with the fitting shaft portion is in contact with the front surface of the holder main body, the gap enlarging gradually from the vicinity of the connecting portion toward an outer circumferential edge of the lens holding portion.

Effect of the Invention

According to the present invention, when the lens holding portion is urged against the processing target lens, the elastic member elastically deforms toward the rear side due to the gap formed with respect to the holder main body and brings the lens holding surface into tight contact with the processing target lens. Hence, the contact area of the processing target lens with the lens holding surface of the elastic member enlarges to provide a large lens holding force. As a result, axial deviation of the processing target lens caused by the processing resistance during edging can be prevented.

BEST MODE FOR CARRYING OUT THE INVENTION

Figure 1:
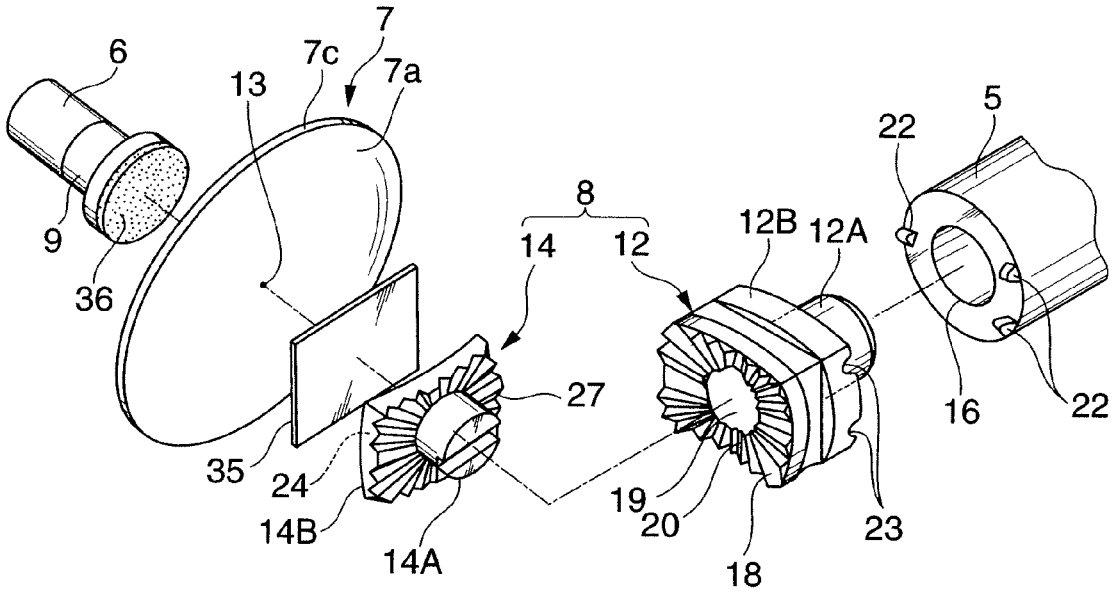
FIG. 1 is an exploded perspective view of a lens holder according to the present invention.

The present invention will be described in detail hereinafter based on an embodiment shown in the accompanying drawings.

Referring to FIGS. 1 to 6, an edging apparatus 1 includes a lens holding shaft 2 and processing tool rotating shaft 3 arranged parallel to each other. The lens holding shaft 2 includes first and second lens holding shafts 5 and 6 arranged such that their axes coincide with each other. A processing target lens 7 is mounted between the opposing surfaces of the lens holding shafts 5 and 6 as it is sandwiched by a lens holder 8 and lens retainer 9. A grinding wheel 10 serving as a processing tool which edges an outer circumferential surface 7*c* of the processing target lens 7 is mounted on the processing tool rotating shaft 3. The grinding wheel 10 includes a grinding wheel 10A for rough processing and a grinding wheel 10B for finishing. A beveling groove 11 is formed in the circumferential surface of the grinding wheel 10B.

Figure 7:
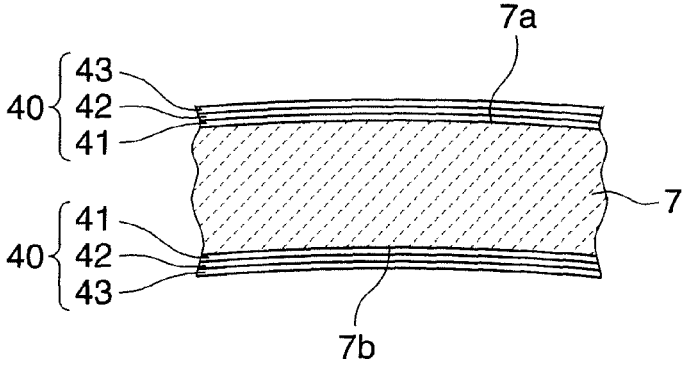
FIG. 7 is an enlarged sectional view of the main part showing protective film layers on the processing target lens.

Referring to FIG. 7, the processing target lens 7 is formed of a round (with a diameter of, e.g., 80 mm) plastic minus-power lens formed by casting and polymerization. A protective film layer 40 and water-repellent film layer 43 are stacked on entire each surface of the processing target lens 7. The protective film layer 40 is formed to improve the optical characteristics, durability, resistance to marring, and the like of the lens, and ordinarily includes a hard coat film layer 41 and antireflection film layer 42. The water-repellent film layers 43 are formed to improve the antifouling properties of a convex optical surface 7*a* and concave optical surface 7*b* by enhancing their smoothness, and prevent water stain. Lately, a super-water-repellent lens having high lubricating properties is becoming popular. As the water-repellent material, for example, one containing an organosilicon compound containing a fluorine-substituted alkyl group is employed. The protective film layer 40 and water-repellent film layer 43 will be described later.

The lens holder 8 includes a metal holder main body 12 made of stainless steel, an aluminum alloy, iron, or the like, and an elastic member 14 which is attached to the holder main body 12 and holds a processing center portion 13 of the convex optical surface 7*a* of the processing target lens 7.

The holder main body 12 includes a cylindrical fitting shaft portion 12A to be fitted in a fitting hole 16 of the first lens holding shaft 5, and an elastic member attaching portion 12B integrally provided to the front end of the fitting shaft portion 12A.

For example, the elastic member attaching portion 12B is formed of an almost rectangular parallelepiped block with approximately a length of 24 mm, a height of 16 mm, and a depth of 13 mm which has two convex curved side surfaces. A front surface 18 of the elastic member attaching portion 12B integrally has a through hole 19 and a plurality of projections 20. The through hole 19 has a diameter of approximately 10 mm and opens in the rear surface of the fitting shaft portion 12A.

The projections 20 are formed radially on the front surface 18 to surround the through hole 19. Each projection 20 has two slopes 21*a* and 21*b* inclined at almost the same angle in opposite directions, so it forms a V-shaped projection, a section of which perpendicular to the longitudinal direction is axi-symmetrical. The height of the projection 20 gradually increases from an inner end 32*a* toward an outer end 32*b* (FIG. 3), and similarly its width gradually enlarges from the inner end 32*a* toward the outer end 32*b*. As a result, a ridge line 20*a* of the projection 20 is inclined at 85° with respect to an axis L of the holder main body 12 and at a small angle θ (approximately satisfying θ=5°) with respect to a valley line 20*b*. The valley line 20*b* is perpendicular to an axis L of the lens holder 8.

Engaging recesses 23 which engage with rotation-preventive projections 22 formed on the front end face of the first lens holding shaft 5 are formed in the two side surfaces of the holder main body 12 on the rear end side.

The elastic member 14 includes a cylindrical fitting shaft portion 14A to be slidably fitted in the through hole 19 of the holder main body 12, and a flange-like lens holding portion 14B integrally provided at the front end portion of the outer circumferential surface of the fitting shaft portion 14A. As the material of the elastic member 14, a rubber material with an international rubber hardness degree of approximately 90°, e.g., soft urethane rubber, is used.

The lens holding portion 14B has a thickness of approximately 2.5 mm to 3 mm and forms a plate member having the same size as that of the front surface of the holder main body 12. The lens holding portion 14B forms the curved plate member having a concave front surface and convex rear surface. The front surface of the lens holding portion 14B forms a lens holding surface 24. In more detail, the lens holding surface 24 preferably forms a concave spherical surface having a curve larger than the lens curve of the convex optical surface 7*a* of the processing target lens 7. For example, when the processing target lens is of curve 0.5 to curve 8, the suitable surface shape of the lens holding surface 24 is of approximately curve 8 to curve 9. When the processing target lens is of curve 0.5 to curve 5, the suitable surface shape of the lens holding surface 24 is of curve 5 to curve 6. A circular recess 25 approximately having a diameter of 8 mm and a depth of 1 mm to 2 mm is formed at the center of the lens holding surface 24.

The rear surface of the lens holding portion 14B further has an annular groove 26 and a plurality of projections 27. The annular groove 26 serves to facilitate the back-and-fro elastic deformation of the lens holding portion 14B and includes an annular groove extending in the entire outer surface of the fitting shaft portion 14A.

Figure 3:
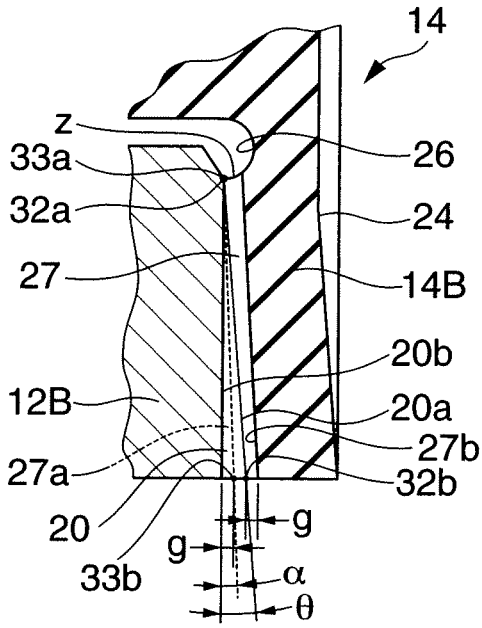
FIG. 3 is an enlarged sectional view of the main part of the lens holder.

The projections 27 are formed to mesh with the projections 20 of the holder main body 12, so that the center of the elastic member 14 coincides with the center of the holder main body 12, thus preventing rotation of the elastic member 14. The projections 27 radially project outside the annular groove 26. Similar to the projections 20, each projection 27 is formed such that its width gradually enlarges from an inner end 33*a* toward an outer end 33*b*. Each projection 27 has two slopes 28*a* and 28*b* inclined at almost the same angle in opposite directions, so it forms a V-shaped projection, a section of which perpendicular to the longitudinal direction is axi-symmetrical. The inner end 33*a* is inclined at 87.15° with respect to an axis L of the elastic member 14 and at a small angle α (α=2.45°) with respect to a plane perpendicular to the axis L. Thus, the inner end 33*a* is located behind the outer end 33*b* (FIG. 3). A ridge line 27*a* and valley line 27*b* of the projection 27 are almost parallel to each other.

Figure 2:
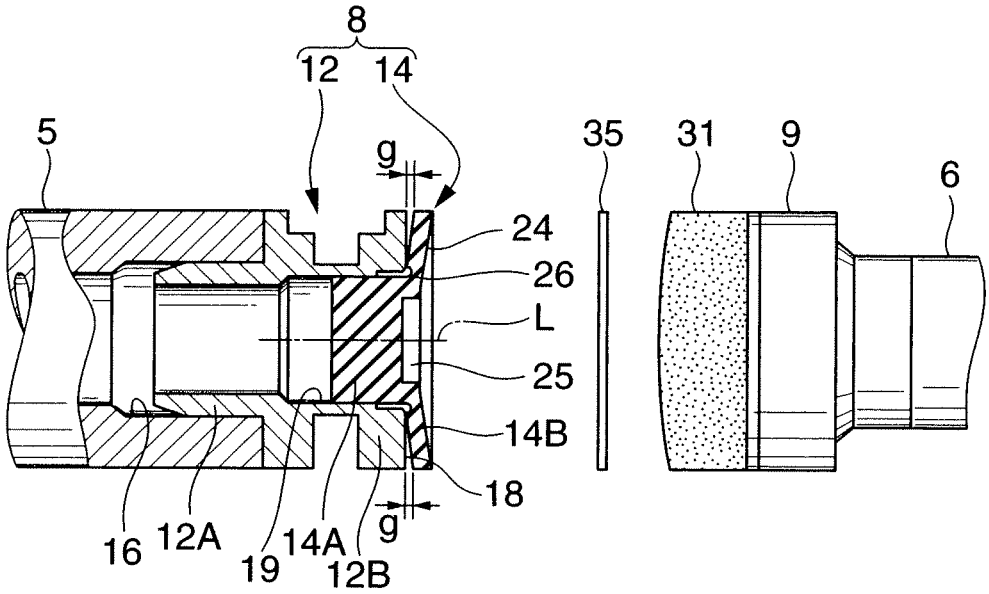
FIG. 2 is a sectional view showing the state of the lens holder before holding a lens.

Hence, assume that the elastic member 14 is mounted on the holder main body 12 by fitting the fitting shaft portion 14A in the fitting hole 16 of the holder main body 12, as shown in FIG. 2. In this state, before the processing target lens 7 is held, the rear surface of the lens holding portion 14B forms a gap g with the front surface 18. In the gap g, a vicinity z (FIG. 3) of the connecting portion with respect to the fitting shaft portion 14A, that is, the outer circumferential edge portion of the annular groove 26 is in contact with the front surface 18 of the holder main body 12 (to leave no gap). The gap g enlarges gradually from the vicinity z of the connecting portion toward the outer circumferential edge of the lens holding portion 14B. The gap g will be described in more detail. As the inner ends 33*a* of the ridge lines 27*a* of the projections 27 and the inner ends 32*a* of the valley lines 20*b* of the corresponding projections 20 are in contact with each other, no gap g is formed between them. Between the ridge lines 20*a* of the projections 20 and the valley lines 27*b* of the corresponding projections 27, and between the valley lines 20*b* of the projections 20 and the ridge lines 27*a* of the corresponding projections 27, the gap g (see FIGS. 3 and 4) gradually enlarges as it is farther away from the vicinity of the connecting portion with respect to the fitting shaft portion 14A. As the elastic member attaching portion 12B and lens holding portion 14B are rectangular, the gap g is not constant in the outer surface of the lens holding portion 14B. The gap g is small (e.g., 0.04 mm) on a long-side side which is close to the center of the holder main body 12, and is large (e.g., 0.22 mm) on a short-side side which is far from the center of the holder main body 12. When the elastic member attaching portion 12B and lens holding portion 14B are round, the gap g in the outer surface of the lens holding portion 14B can have a constant value throughout the entire portion.

Figure 6:
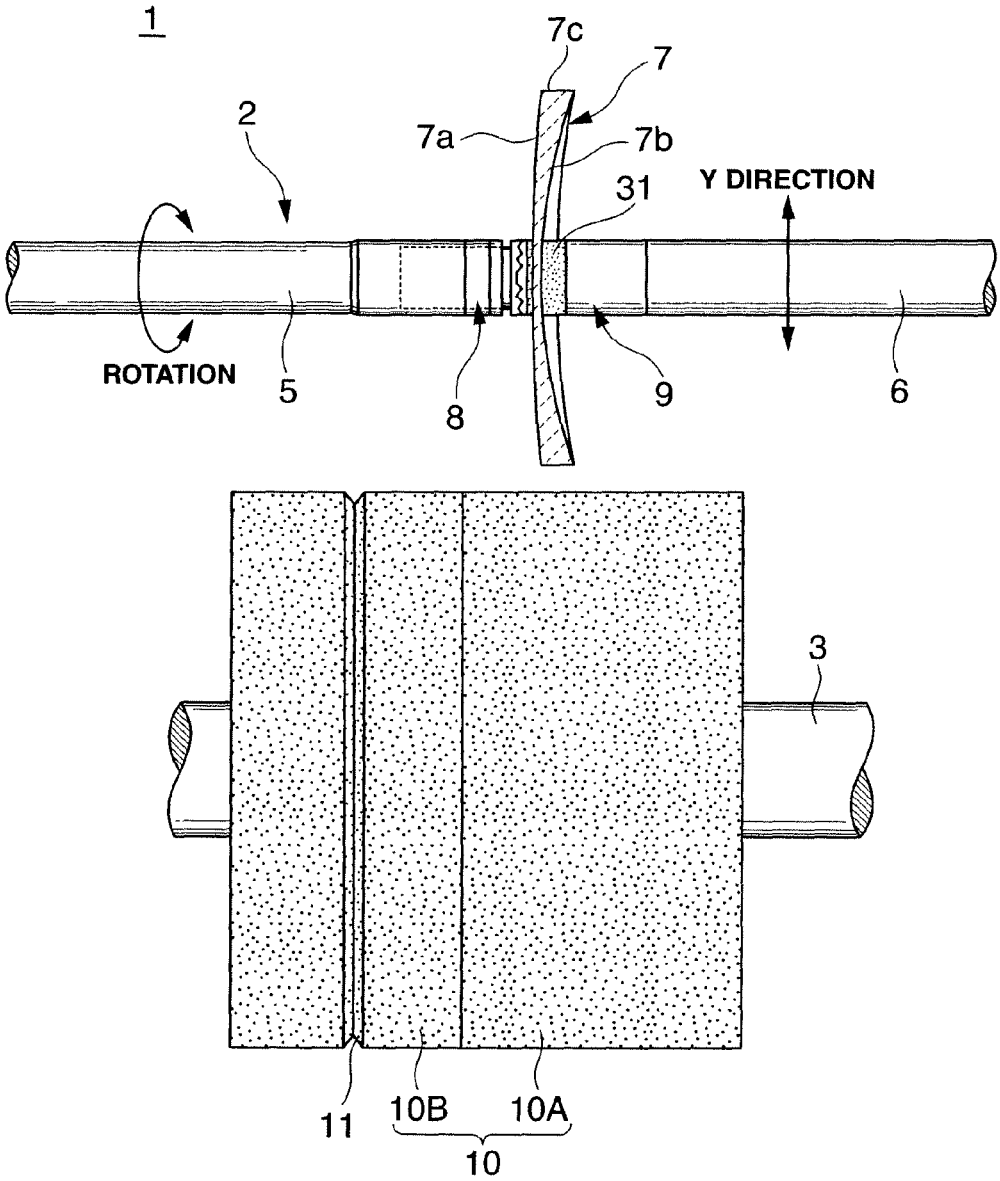
FIG. 6 is a view to explain edging of the processing target lens.

Edging of the processing target lens will be described based on FIG. 6.

First, the processing target lens 7 is attached to the lens holder 8 through a leap tape 35 (FIG. 1). The leap tape 35 has two surfaces coated with an adhesive agent and is adhered to the lens holding surface 24 of the lens holder 8 in advance. When the leap tape 35 is urged against the processing center portion 13 of the convex optical surface 7*a* of the processing target lens 7, the processing target lens 7 is held by the lens holder 8 through the leap tape 35. The processing center of the processing target lens 7 coincides with the frame center of the spectacle frame, or the optical center of the lens.

Then, the processing target lens 7 is mounted on the lens holding shaft 2. When mounting the processing target lens 7 on the lens holding shaft 2, first, the lens holder 8 which holds the processing target lens 7 is mounted on the first lens holding shaft 5. The lens holder 8 can be mounted on the first lens holding shaft 5 by fitting the fitting shaft portion 12A in the fitting hole 16 formed in the distal end face of the first lens holding shaft 5 and engaging the engaging projections 22 and engaging recesses 23 (FIG. 1) with each other.

Subsequently, the second lens holding shaft 6 is moved forward to urge the lens retainer 9 attached to the distal end of the rotating shaft 6 against the concave optical surface 7*b* of the processing target lens 7 through an elastic member 36. Accordingly, the processing center portion 13 of the convex optical surface 7*a* and a processing center portion 13 of the concave optical surface 7*b* of the processing target lens 7 are sandwiched by the lens holder 8 and lens retainer 9. Thus, the lens is completely mounted on the lens holding shaft 2.

Figure 4:
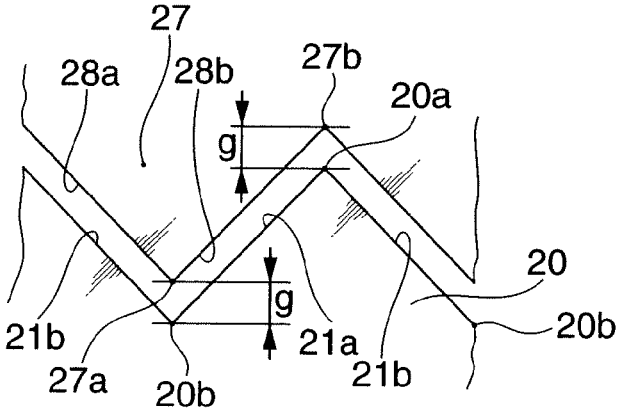
FIG. 4 is an enlarged side view of the main part of the lens holder.
Figure 5:
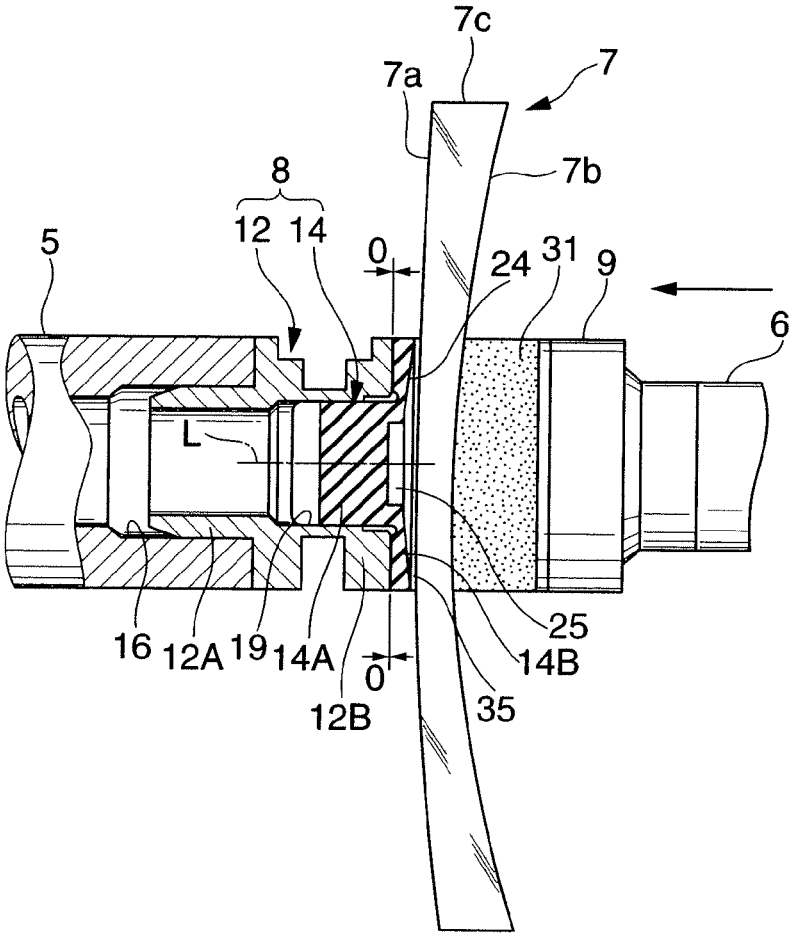
FIG. 5 is a sectional view showing a state in which the lens holder and a lens retainer hold a processing target lens.

When the lens retainer 9 presses the concave optical surface 7*b* of the processing target lens 7 to urge the processing target lens 7 against the lens holder 8 through the leap tape 35, the lens holding portion 14B of the elastic member 14 elastically deforms toward the rear side about the annular groove 26 as the fulcrum because of the presence of the gap g between the projections 20 and 27. Hence, the leap tape 35 also deforms along the convex optical surface 7*a* of the processing target lens 7, and its contact area with the convex optical surface 7*a* enlarges. The ridge lines 27*a* and valley lines 27*b* of the projections 27 of the elastic member 14 are urged against the valley lines 20*b* and ridge lines 20*a*, respectively, of the projections 20 of the holder main body 12. After the gap g becomes zero, as shown in FIG. 4, the elastic member 14 compressively deforms by a predetermined amount to further enlarge the contact area of the processing target lens 7 with the leap tape 35. Hence, the entire surface of the leap tape 35 comes into tight contact with the convex optical surface 7*a* so that the processing target lens 7 can be held with a large lens holding force. Thus, the processing target lens 7 is completely mounted on the lens holding shaft 2.

When the processing target lens 7 is completely mounted on the lens holding shaft 2, the lens holding shaft 2 and processing tool rotating shaft 3 are rotated. At the same time, the lens holding shaft 2 is moved in a direction (the direction of an arrow Y) perpendicular to the axis based on lens frame shape data, and the circumferential surface 7*c* of the processing target lens 7 is roughly processed. The grinding wheel 10A for rough-processing performs this rough processing. After the circumferential surface 7*c* is roughly processed into a predetermined shape, the grinding wheel 10B for finishing finishes the processing target lens 7 into an edged lens shape complying with the frame shape of the spectacle frame, thus completely edging the lens 7. During this finishing, the beveling groove 11 forms a bevel including a V-shaped projection in the circumferential surface of the processing target lens 7.

The angle $\alpha$ of the gap g is preferably 0.1° to 3° (the optimum gap angle is in the vicinity of 0.25°). The width of the gap g is preferably 0.1 mm to 0.5 mm (the optimum gap width is in the vicinity of 0.20 mm). The hardness of the elastic member 14 is preferably 80° to 100° (the optimum hardness is in the vicinity of 90°).

Examples of the optical base material of the processing target lens 7 include, e.g., a copolymer formed from methyl methacrylate and at least another monomer, a copolymer formed from diethylene glycol bis(allyl carbonate) and at least another monomer, and a vinyl copolymer containing polycarbonate, urethane, polystyrene, polyvinyl chloride, unsaturated polyester, polyethylene terephthalate, polyurethane, polythiourethane, sulfide utilizing an enthiol reaction, or sulfur. Although a urethane-based optical base material and an allyl-based optical base material are particularly preferable among these base materials, the present invention is not limited to them. The optical base material of the present invention is preferably a plastic optical base material, and more preferably a plastic optical base material for spectacles.

The hard coat film layer 41 of the protective film layer 40 is formed on each of the front and rear surfaces of the lens to enhance the hardness of the spectacle lens itself and improve the resistance to marring. As the material of the hard coat film layer 41, an organic substance such as a silicon-based resin is used. The hard coat film layer 41 is formed by applying a silicon-based resin made of a solvent by dipping or spin coating and curing the applied resin by heating in a heating furnace. This method of forming the hard coat film layer 41 is conventionally known well.

The antireflection film layer 42 is formed on the hard coat film layer 41 to enhance the antireflection effect and the resistance to marring. The antireflection film layer 42 is formed from a plurality of different materials so it forms a multilayered antireflection film layer. As an antireflecting material, for example, a metal oxide or silicon oxide of Zr, Ti, Sn, Si, In, or Al, or $MgF_2$ is used. Such a multilayered antireflection film layer 42 is formed by vacuum deposition described in, e.g., Japanese Patent Laid-Open No. 11-333685.

The multilayered antireflection film layer 42 is preferably formed by an ion-assisted deposition method so that it obtains a high film strength and good adhesion. The layers that form films other than a hybrid layer of the antireflection film are tantalum oxide ($Ta_2O_5$) layers serving as high-refractive layers so that physical properties such as a good antireflection effect and resistance to marring can be obtained. Each tantalum oxide layer contains preferably at least 50 wt % of tantalum oxide and more preferably 80 wt % or more of tantalum oxide.

According to the ion-assisted deposition method, the preferable output range of the acceleration voltage is 50 V to 700 V and that of the acceleration current is 30 mA to 250 mA from the viewpoint of obtaining a particularly good reaction. As an ionization gas used when practicing the ion-assisted deposition method, argon (Ar) or a gas mixture of argon and oxygen is preferably used in consideration of the reactivity and oxidation prevention during film formation.

The inorganic substance used in the hybrid layer of the present invention must include silicon dioxide and can include at least one member selected from the group consisting of aluminum oxide, titanium oxide, zirconium oxide, tantalum oxide, yttrium oxide, and niobium oxide. When using a plurality of inorganic substances, they may be mixed physically. Alternatively, the inorganic substance can be a composite oxide, e.g., silicon dioxide ($SiO_2$) or aluminum monoxide ($Al_2O_3$). Among them, silicon dioxide alone and at least one type of inorganic oxide selected from the group consisting of silicon dioxide and aluminum oxide are preferable.

As the organic substance used to form the hybrid layer of the present invention, an organic silicide which is liquid at normal temperature and normal pressure and/or an organic compound not containing silicon, which is liquid at normal pressure, is preferable from the viewpoint of film thickness control and deposition rate control.

The organic silicide preferably has any one of the structures represented by the following general formulas (a) to (d):

General Formula (a): Silane/Siloxane Compound

[Chemical 1]

(a)

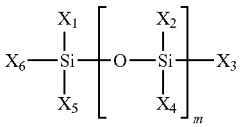

General Formula (b): Silazane Compound

[Chemical 2]

(b)

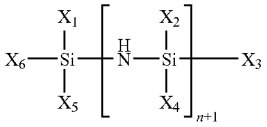

General Formula (c): Cyclosiloxane Compound

[Chemical 3]

(c)

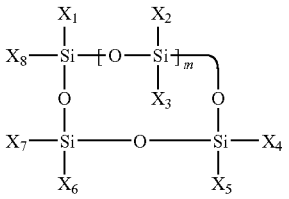

General Formula (d): Cyclosilazane Compound

[Chemical 4]

(d)

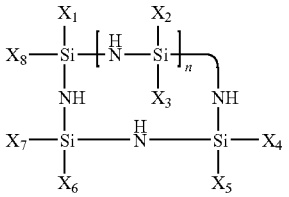

In general formulas (a) to (d), m and n each independently represent an integer of 0 or more. $X_1$ to $X_8$ each independently represent hydrogen, a hydrocarbon group (including both saturated and unsaturated hydrocarbon groups) having 1 to 6 carbon atoms, an —$OR^1$ group, a —$CH_2OR^2$ group, a —$COOR^3$ group, an —$OCOR^4$ group, an —$SR_5$ group, a —$CH_2SR^6$ group, an —$NR^7{}_2$ group, or a —$CH_2NR^8{}_2$ group [$R^1$ to $R^8$ each independently represent hydrogen or a hydrocarbon group (including both saturated and unsaturated hydrocarbon groups) having 1 to 6 carbon atoms. $X_1$ to $X_8$ may be arbitrary ones of the above functional groups and may all be the same or different.

Specific examples of the hydrocarbon group having 1 to 6 carbon atoms represented by $R^1$ to $R^8$ include a methyl group, ethyl group, n-propyl group, isopropyl group, n-butyl group, isobutyl group, pentyl group, hexyl group, vinyl group, allyl group, ethynyl group, phenyl group, cyclohexyl group, propenyl group, and isopropenyl group.

Specific examples of the compound represented by general formula (a) include trimethylsilanol, tetramethylsilane, diethylsilane, dimethylethoxysilane, hydroxymethyltrimethylsilane, methoxytrimethylsilane, dimethoxydimethylsilane, methyltrimethoxysilane, mercaptomethyltrimethoxysilane, tetramethoxysilane, mercaptomethyltrimethylsilane, aminomethyltrimethylsilane, dimethyl(dimethylamino)silane, ethynyltrimethylsilane, diacetoxymethylsilane, allyldimethylsilane, trimethylvinylsilane, methoxydimethylvinylsilane, acetoxytrimethylsilane, trimethoxyvinylsilane, diethylmethylsilane, ethyltrimethylsilane, ethoxytrimethylsilane, diethoxymethylsilane, ethyltrimethoxysilane, dimethylaminotrimethylsilane, bis(dimethylamino)methylsilane, phenylsilane, dimethyldivinylsilane, 2-propynyloxytrimethylsilane, dimethylethoxyethynylsilane, diacetoxydimethylsilane, allyltrimethylsilane, allyloxytrimethylsilane, ethoxydimethylvinylsilane, isopropenoxytrimethylsilane, allylaminotrimethylsilane, trimethylpropylsilane, trimethylisopropylsilane, triethylsilane, diethyldimethylsilane, butyldimethylsilane, trimethylpropoxysilane, trimethylisopropoxysilane, triethylsilanol, diethoxydimethylsilane, propyltrimethoxysilane, diethylaminodimethylsilane, bis(ethylamino)dimethylsilane, bis(dimethylamino)dimethylsilane, tri(dimethylamino)silane, methylphenylsilane, methyltrivinylsilane, diacetoxymethylvinylsilane, methyltriacetoxysilane, allyloxydimethylvinylsilane, diethylmethylvinylsilane, diethoxymethylvinylsilane, bis(dimethylamino)methylvinylsilane, butyldimethylhydroxymethylsilane, 1-methylpropoxytrimethylsilane, isobutoxytrimethylsilane, butoxytrimethylsilane, butyltrimethoxysilane, methyltriethoxysilane, isopropylaminomethyltrimethylsilane, diethylaminotrimethylsilane, methyltri(dimethylamino)silane, dimethylphenylsilane, tetravinylsilane, triacetoxyvinylsilane, tetraacetoxysilane, ethyltriacetoxysilane, diallyldimethylsilane, 1,1-dimethylpropynyloxytrimethylsilane, diethoxydivinylsilane, butyldimethylvinylsilane, dimethylisobutoxyvinylsilane, acetoxytriethylsilane, triethoxyvinylsilane, tetraethylsilane, dimethyldipropylsilane, diethoxydiethylsilane, dimethyldipropoxysilane, ethyltriethoxysilane, tetraethoxysilane, methylphenylvinylsilane, phenyltrimethylsilane, dimethylhydroxymethylphenylsilane, phenoxytrimethylsilane, dimethoxymethylphenylsilane, phenyltrimethoxysilane, anilinotrimethylsilane, 1-cyclohexenyloxytrimethylsilane, cyclohexyloxytrimethylsilane, dimethylisopentyloxyvinylsilane, allyltriethoxysilane, tripropylsilane, butyldimethyl-3-hydroxypropylsilane, hexyloxytrimethylsilane, propyltriethoxysilane, hexyltrimethoxysilane, dimethylphenylvinylsilane, trimethylsilylbenzonate, dimethylethoxyphenylsilane, methyltriisopropenoxysilane, methoxytripropylsilane, dibutoxydimethylsilane, methyltripropoxysilane, bis(butylamino)dimethylsilane, divinylmethylphenylsilane, diacetoxymethylphenylsilane, diethylmethylphenylsilane, diethoxymethylphenylsilane, triisopropoxyvinylsilane, 2-ethylhexyloxytrimethylsilane, pentyltriethoxysilane, diphenylsilane, diphenylsilanediolphenyltrivinylsilane, triethylphenylsilane, phenyltriethoxysilane, tetraallyloxysilane, phenyltri(dimethylamino)silane, tetrapropoxysilane, tetraisopropoxysilane, diphenylmethylsilane, diallylmethylphenylsilane, dimethyldiphenylsilane, dimethoxydiphenylsilane, dianilinodimethylsilane, diphenylethoxymethylsilane, tripentyloxysilane, diphenyldivinylsilane, diacetoxydiphenylsilane, diethyldiphenylsilane, diethoxydiphenylsilane, bis(dimethylamino)diphenylsilane, tetrabutylsilane, tetrabutoxysilane, triphenylsilane, diallyldiphenylsilane, trihexylsilane, triphenoxyvinylsilane, 1,1,3,3-tetramethyldisiloxane, pentamethyldisiloxane, hexamethyldisiloxane, 1,3-dimethoxytetramethyldisiloxane, 1,3-diethinyl-1,1,3,3-tetramethyldisiloxane, 1,3-divinyl-1,1,3,3-tetramethyldisiloxane, 1,3-diethoxytetramethyldisiloxane, hexaethyldisiloxane, and 1,3-dibutyl-1,1,3,3-tetramethyldisiloxane.

Specific examples of the compound represented by general formula (b) include 1,1,3,3-tetramethyldisilazane, hexamethyldisilazane, and 1,3-divinyl-1,1,3,3-tetramethyldisilazane.

Specific examples of the compound represented by general formula (c) include hexamethylcyclotrisiloxane, hexaethylcyclotrisiloxane, 1,3,5,7-tetramethylcyclotetrasiloxane, and octamethylcyclotetrasiloxane.

Specific examples of the compound represented by general formula (d) include 1,1,3,3,5,5-hexamethylcyclotrisilazane and 1,1,3,3,5,5,7,7-octamethylcyclotetrasilazane.

The number average molecular weights of these organosilicon compounds fall within the range of preferably 48 to 600 and most preferably 140 to 500 from the viewpoint of control of organic components in hybrid films and the strengths of the films themselves.

A non-silicon-containing organic compound of the hybrid layer includes preferably a compound containing hydrogen and carbon as indispensable components and having a reactive group at its side chain or terminal, and more specifically a compound represented by general formulas (e) to (g).

General Formula (e): Non-Silicon-Containing Organic Compound Containing Carbon and Hydrogen as Indispensable Components and Having an Epoxy Group at One Terminal

[Chemical 5]

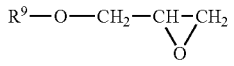

(e)

General Formula (f): Non-Silicon-Containing Organic Compound Containing Carbon and Hydrogen as Indispensable Components and Having Epoxy Groups at Two Terminals

[Chemical 6]

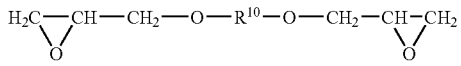

(f)

General Formula (g): Non-Silicon-Containing Organic Compound Containing Carbon and Hydrogen as Indispensable Components and Having a Double Bond $$CX_9X_{10}{=}CX_{11}X_{12} \quad (g)$$

In general formulas (e) and (f), $R^9$ represents hydrogen or a hydrocarbon group which has 1 to 10 carbon atoms and may contain oxygen, and $R^{10}$ represents a divalent hydrocarbon group which has 1 to 7 carbon atoms and may contain oxygen. In general formula (g), $X_9$ to $X_{12}$ each independently represent hydrogen, a hydrocarbon group having 1 to 10 carbon atoms, or an organic group containing hydrogen and carbon having 1 to 10 carbon atoms as indispensable components and at least one of oxygen and nitrogen as an indispensable component.

Specific examples of the compound represented by general formula (e) include methyl glycidyl ether, butyl glycidyl ether, 2-ethylhexydyl glycidyl ether, decyl glycidyl ether, stearyl glycidyl ether, allyl glycidyl ether, phenyl glycidyl ether, p-sec-butylphenyl glycidyl ether, p-tert-butylphenyl glycidyl ether, 2-methyloctyl glycidyl ether, glycidol, trimethylol, and propane polyglycidyl ether.

Specific examples of the compound represented by general formula (f) include neopentyl glycol diglycidyl ether, glycerol diglycidyl ether, glycerol triglycidyl ether, propylene glycol diglycidyl ether, tripropylene glycol diglycidyl ether, polypropylene glycol diglycidyl ether, 1,6-hexanediol diglycidyl ether, ethylene glycol diglycidyl ether, diethylene glycol diglycidyl ether, and polyethylene glycol diglycidyl ether.

Specific examples of general formula (g) include ethylene, propylene, vinyl chloride, vinyl fluoride, acrylamide, vinylpyrrolidone, vinylcarbazole, methyl methacrylate, ethyl methacrylate, benzyl methacrylate, n-butyl methacrylate, isobutyl methacrylate, dimethyl amino ethyl methacrylate, mathacrylic acid, glycidyl methacrylate, vinyl acetate, and styrene.

The number average molecular weights of these compounds represented by general formulas (e) to (g) fall within the range of preferably 28 to 4,000 and most preferably 140 to 360 in consideration of control of organic components in hybrid films and the strengths of the films themselves.

As a method of forming an organosilicon compound which is liquid at normal temperature and normal pressure and/or a non-silicon-containing organic compound (to be also referred to as an organic material hereinafter) which is liquid at normal temperature and normal pressure, it is preferable to simultaneously deposit hybrid films using different vapor sources of inorganic and organic materials. More specifically, an inorganic material is heated to evaporate using an electron gun or the like. An organic material is stored in an external tank and evaporated in this tank. The inorganic and organic materials are then simultaneously deposited.

Preferably, the external tank which stores an organic material is heated and evacuated, the organic material is supplied to the chamber, and oxygen gas and/or argon gas is used to perform ion-assisted deposition in view of deposition rate control. In the present invention, the organic material is liquid at normal temperature and normal pressure. The present invention does not need a solvent, and allows direct heating and evaporation of the organic material. It is effective to arrange the supply port of the organic material right above the inorganic material vapor source to improve impact resistance and wear resistance. It is preferable to supply the organosilicon compound upward and supply downward the non-silicon-containing organic compound having a reactive group at its side chain or terminal and containing carbon and hydrogen as indispensable components.

The heating temperature of the external tank falls within the range of 30 to 200° C. and preferably 50 to 150° C. to obtain an appropriate deposition rate, depending on the vaporization temperatures of organic materials.

The content of the organic material in the hybrid layer according to the present invention falls within the range of 0.020 to 25 wt % particularly in consideration of a better physical property improvement effect.

The preferable film thickness and refractive index ranges of the present invention are as follows. In this case, λ represents the wavelength of light.

| | | |
|---|---|---|
| First layer | 0.005λ to 1.25λ | 1.41 to 1.50 |
| Second layer | 0.005λ to 0.10λ | 2.00 to 2.35 |
| Third layer | 0.005λ to 1.25λ | 1.41 to 1.50 |
| Fourth layer | 0.05λ to 0.45λ | 2.00 to 2.35 |
| Fifth layer | 0.005λ to 0.15λ | 1.41 to 1.50 |
| Sixth layer | 0.05λ to 0.45λ | 2.00 to 2.35 |
| Seventh layer | 0.2λ to 0.29λ | 1.41 to 1.50 |

The above physical properties of the films can achieve the target physical properties.

The uppermost water-repellent film layer 43 is formed on the antireflection film layer 42, thereby increasing the smoothness of the lens surface to improve the antifouling properties and preventing water stain. The water-repellent film layer 43 is formed on the seventh layer of the multilayered antireflection film layer 42 by vacuum deposition using, e.g., an organosilicon compound containing a fluorine-substituted alkyl group as the material.

The material and formation method of the water-repellent film layer 43 preferably employ a method described in Japanese Patent Laid-Open No. 2004-122238. According to this method, the organosilicon compound containing the fluorine-substituted alkyl group diluted with a solvent is set in a reduced pressure. The process from the start of heating to the deposition is preferably finished within 90 sec and preferably 10 sec in the temperature range equal to or higher than the deposition start temperature of this organosilicon compound and not exceeding its decomposition temperature. A method which achieves this deposition time range is preferably a method which irradiates the organosilicon compound with an electron beam.

A compound represented by general formula (h) or unit formula (i) is preferably used as the organosilicon compound containing the fluorine-substituted alkyl group.

[Chemical 7]

(h)

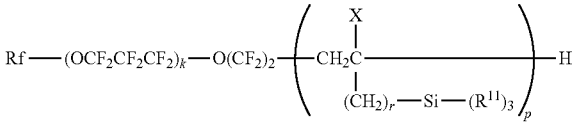

In general formula (h), RF represents a straight chain perfluoroalkyl group having 1 to 16 carbon atoms, X represents hydrogen or a lower alkyl group having 1 to 5 carbon atoms, $R^{11}$ represents a hydrolyzable group, k is an integer of 1 to 50, r is an integer of 0 to 2, and p is an integer of 1 to 10.

$$CqF_2q+1CH_2CH_2Si(NH_2)_3 \quad (i)$$

wherein q is an integer of 1 or more.

Examples of the hydrolyzable group represented by $R^{11}$ include an amino group, an alkoxy group particularly an alkoxy group including an alkyl part having 1 to 2 carbon atoms, and a chlorine atom.

Specific examples of the compound represented by unit formula (i) include n-$CF_3CH_2CH_2Si(NH_2)_3$; n-trifluoro(1,1,2,2-tetrahydro)propylsilazane, n-$C_3F_7CH_2CH_2Si(NH_2)_3$; n-heptafluoro(1,1,2,2-tetrahydro)pentylsilazane, n-$C_4F_9CH_2CH_2Si(NH_2)_3$; n-nonafluoro(1,1,2,2-tetrahydro)hexylsilazane, n-$C_6F_{13}CH_2CH_2Si_2(NH_2)_3$; n-trideofluoro(1,1,2,2-tetrahydro)octylsilazane, and n-$C_8F_{17}CH_2CH_2Si(NH_2)_3$; n-heptadecafluoro(1,1,2,2-tetrahydro)decylsilazane.

The material of the water-repellent film layer 43 may contain as two major components the organosilicon compound containing the fluorine-substituted alkyl group and perfluoropolyether not containing silicon. In addition, a first layer may be formed from these major components, and a second layer may be formed on the first layer using a material containing as a major component perfluoropolyether not containing silicon, thereby forming the water-repellent film layer.

The perfluoropolyether not containing silicon preferably employs a compound consisting of a unit having the following structural formula:

$$—(R^{12}O)— \quad (j)$$

In formula (j), $R^{12}$ represents a perfluoroalkylene group having 1 to 3 carbon atoms. The average molecular weight falls within the range of 1,000 to 10,000 and more preferably 2,000 to 10,000. R represents a perfluoroalkylene group having 1 to 3 carbon atoms, and its specific examples include groups such as $CF_2$, $CF_2$—$CF_2$, $CF_2CF_2CF_2$, and $CF(CF_2)CF_2$. These perfluoropolyethers are liquid at normal temperature and called fluorine oils.

In the spectacle lens of the present invention, a layer made from at least one metal selected from metals having a catalyst function in forming a hybrid layer (to be described later), such as nickel (Ni), silver (Ag), platinum (Pt), niobium (Nb), and titanium (Ti) can be formed as an underlayer below an antireflection film layer in order to improve the bonding property. The most preferable underlayer is a metal layer made from niobium to impart better impact resistance. Use of the metal layer as the underlayer enhances the reaction with the hybrid layer formed on the underlayer, thereby obtaining a material having an intra-molecular network structure and improving the impact resistance.

According to the present invention, it is also preferable to form a double layer structure inside the uppermost water-repellent film layer 43, i.e., the first and second water-repellent layers. For example, a vapor material containing a mixture of the organosilicon compound containing the fluorine-substituted alkyl group represented by general formula (I) and at least one silane compound selected from the following general formulas (II-1), (II-2), and (II-3) is deposited on the optical member to form the first water-repellent layer. The resultant structure is dipped in a dipping material containing a solvent and perfluoropolyether-polysiloxane copolymer modified silane represented by general formula (III) to form the second water-repellent layer, thereby forming a water-repellent film layer 43 made from the two layers.

General formula (I)
[Chemical 8]

(I)

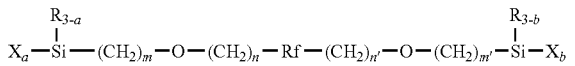

In general formula (I), Rf represents a divalent group which includes a unit represented by formula —($C_kF_{2k}O$)— (wherein k is an integer of 1 to 6) and has an unbranched straight chain perfluoropolyalkylene ether structure. R independently represents a monovalent hydrocarbon group having 1 to 8 carbon atoms. X independently represents a hydrolyzable group or halogen atom, n and n' each represent an integer of 0 to 2, m and m' each represent an integer of 1 to 5, and a and b each represent 2 or 3.

General Formula (II)
[Chemical 9]

$R'—Si(OR'')_3$ General formula (II-1)

$Si(OR'')_4$ General formula (II-2)

$SiO(OR'')_3Si(OR'')_3$ General formula (II-3)

wherein R' represents an organic group and R'' represents an alkyl group.

General formula (III)
[Chemical 10]

(III)

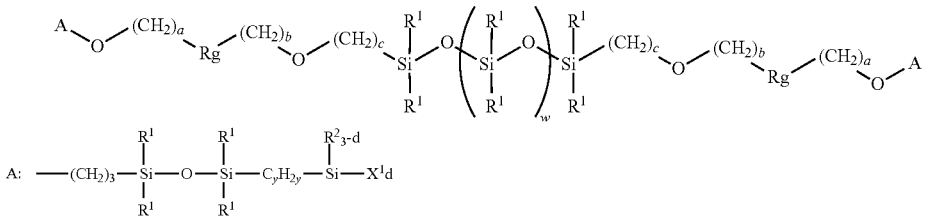

In general formula (III), Rg represents a divalent group which includes a repeating unit represented by formula —($C_jF_{2j}O$)— (wherein j is an integer of 1 to 5) and has an unbranched straight chain perfluoropolyalkylene ether structure. The repeating unit count is 30 to 60. Different j repeating units may be simultaneously included. $R^1$ represents the same or different alkyl groups or phenyl groups having 1 to 4 carbon atoms, w is 30 to 100, and a, b, and c each independently represent an integer of 1 to 5. $R^2$ represents an alkyl group or phenyl group having 1 to 4 carbon atoms, $X^1$ represents a hydrolyzable group, d is 2 or 3, and y is an integer of 1 to 5.

The compounds represented by general formulas (I) to (III) will be described below.

In general formula (I), the Rf group is a divalent group which includes a unit represented by formula —($C_kF_{2k}O$)— (wherein k is an integer of 1 to 6 and preferably 1 to 4, and the sequence of $CkF_{2k}O$ in general formula (I) is random) and has an unbranched straight chain perfluoropolyalkylene ether structure. Note that when both n and n' in general formula (I) are zero, the terminal of the Rf group bonded to the oxygen atom (O) in general formula (I) is not an oxygen atom:

wherein Rf represents a divalent straight chain perfluoropolyether group and include perfluoropolyether groups having a variety of chain lengths. Rf preferably represents a divalent straight chain perfluoropolyether having a perfluoropolyether having 1 to 6 carbon atoms as the repeating unit. Examples of this divalent straight chain perfluoropolyether are as follows:

$$—CF_2CF_2O(CF_2CF_2CF_2O)_rCF_2CF_2—$$

$$—CF_2(OC_2F_4)_s—(OCF_2)_t—$$

wherein r, s, and t each represent an integer of 1 or more. More specifically, r, s, and t each fall within the range of 1 to 50 and more preferably 10 to 40. Note the perfluoropolyether molecular structure is not limited to the exemplified structures.

In general formula (I), X represents a hydrolyzable group or halogen atom. Examples of X as the hydrolyzable group include an alkoxy group such as a methoxy group, ethoxy group, propoxy group, or butoxy group; an alkoxyalkoxy group such as a methoxymethoxy group, methoxyethoxy group, or ethoxyethoxy group; an alkenyloxy group such as an allyloxy group or isopropenoxy group; an asiloxy group such as an acetoxy group, propyonyloxy group, butylcarbonyloxy group, or benzoyloxy group; a ketoxime group such as a dimethylketoxime group, methylethylketoxime group, diethylketoxime group, cyclopentanoxime group, or cyclohexanoxime group; an amino group such as an N-methylamino group, N-ethylamino group, N-propylamino group, N-butylamino group, N,N-dimethylamino group, N,N-diethylamino group, or N-cyclohexylamino group; an amide group such as an N-methylacetoamide group, N-ethylacetoamide group, or N-methylbenzamide group; and an aminooxy group such as an N,N-dimethylaminooxy group or N,N-diethylaminooxy group.

Examples of X as the halogen atom include a chlorine atom, bromine atom, and iodine atom.

Among them all, the methoxy group, ethoxy group, isopropenoxy group, and chlorine atom are most preferable.

In general formula (I), R represents a monovalent hydrocarbon group having 1 to 8 carbon atoms. If R represents a plurality of monovalent hydrogen groups, they may be the same or different. Specific examples of R include an alkyl group such as a methyl group, ethyl group, propyl group, butyl group, pentyl group, hexyl group, heptyl group, or octyl group; a cycloalkyl group such as a cyclopentyl group or cyclohexyl group; an aryl group such as a phenyl group, tolyl group, or xylyl group; an aralkyl group such as a benzyl group or phenetyl group; and an alkenyl group such as a vinyl group, allyl group, butenyl group, pentenyl group, or hexenyl group. Among them all, a monovalent hydrocarbon group having 1 to 3 carbon atoms is preferable, and the methyl group is most preferable.

In general formula (I), n and n' each represent an integer of 0 to 2 and preferably 1, and may be the same or different, m and m' each represent an integer of 1 to 5, preferably 3, and may be the same or different.

Next, a and b each represent 2 or 3 and preferably 3 in view of hydrolysis, condensation reactivity, and bonding property.

The molecular weight of the organosilicon compound containing the fluorine-substituted alkyl group represented by general formula (I) is not particularly limited, but its number average molecular weight appropriately falls within the range of 500 to 20,000 and preferably 1,000 to 10,000 in view of stability and handling.

Specific examples of the organosilicon compound containing the fluorine-substituted alkyl group represented by structural formula (I) are as follows, but are not limited to the exemplified compounds.

$(CH_3O)_3SiCH_2CH_2CH_2OCH_2CF_2CF_2O(CF_2CF_2CF_2O)_1CF_2CF_2CH_2OCH_2CH_2—CHSi(OCH_3)_3$ $(CH_3O)_2CH_3SiCH_2CH_2CH_2OCH_2CF_2CF_2O(CF_2CF_2CF_2O)_1CF_2CF_2CH_2OCH_2CH_2—CH_2SiCH_3(OCH_3)_2$ $(CH_3O)_3SiCH_2CH_2CH_2OCH_2CF_2(OC_2F_4)_p(OCF_2)_qOCF_2—CH_2OCH_2CH_2CH_2Si(OCH_3)_3$ $(CH_3O)_2CH_3SiCH_2CH_2CH_2OCH_2CH_2CF_2(OC_2F_4)_p(OCF_2)_qOCF_2CH_2OCH_2CH_2—CH_2SiCH_3(OCH_3)_2$ $(CH_3O)_3SiCH_2CH_2CH_2OCH_2CH_2CF_2(OC_2F_4)_p(OCF_2)_qOCF_2CH_2CH_2OCH_2CH_2—CH_2Si(OCH_3)_3$ $(C_2H_5O)_3SiCH_2CH_2CH_2OCH_2CH_2CF_2(OC_2F_4)_p(OCF_2)_qOCF_2CH_2OCH_2CH_2CH_2—Si(OC_2H_5)_3$

The compound represented by general formula (I) can be used singly or in a combination of two or more compounds. In some case, the organosilicon compound containing the fluorine-substituted alkyl group and its partial hydrolyzed condensate can be combined and used. In addition, perfluoropolyether-polysiloxane copolymer modified silane represented by general formula (III) can be combined and used with the compound represented by general formula (I).

The organosilicon compound containing the fluorine-substituted alkyl group represented by general formula (I) is preferably diluted with a solvent. Examples of a solvent to be used include a fluorine-modified aliphatic hydrocarbon solvent (e.g., perfluoroheptane or perfluorooctane), a fluorine-modified aromatic hydrocarbon solvent (e.g., 1,3-di(trifluoromethyl)benzene or trifluoromethylbenzene), a fluorine-modified ether solvent (e.g., methylperfluorobutyl ether or perfluoro(2-butyltetrahydrofurane), a fluorine-modified alkylamine solvent (e.g., perfluorotributylamine or perfluorotripentylamine), a hydrocarbon solvent (e.g., petroleum benzene, mineral spirits, toluene, or xylene), a ketone solvent (e.g., acetone, methyl ethyl ketone, or methyl isobutyl ketone), and an alcohol solvent (methanol, ethanol, isopropanol, or n-propanol). These solvents can be used singly or in a combination of two or more solvents. Among them all, a fluorine-modified solvent is preferable in view of the dissolvability and wettability of modified silane. Examples of the most preferable solvent include 1,3-di(trifluoromethyl)benzene, perfluoro(2-butyltetrahydrofurane), and perfluorotributylamine.

One silane compound selected from the general formulas (II-1), (II-2), and (II-3) comprises the following:

| | |
|---|---|
| $R'—Si(OR'')_3$ | General formula (II-1) |
| $Si(OR'')_4$ | General formula (II-2) |
| $SiO(OR'')_3Si(OR'')_3$ | General formula (II-3) |

wherein R' represents an organic group. Examples of R' include an alkyl group (e.g., a methyl group, ethyl group, or propyl group) having 1 to 50 carbon atoms (preferably 1 to 10 carbon atoms), an epoxyethyl group, a glycidyl group, and an amino group. These groups may be substituted. R'' represents an alkyl group (e.g., a methyl group, ethyl group, or propyl group) having 1 to 48 carbon atoms and is preferably a methyl group or ethyl group.

Specific examples of the silane compounds represented by general formulas (II-1) to (II-3) include structural formulas $(C_2H_5O)_3SiC_3H_6NH_2$, $(CH_3O)_3SiC_3H_6NH_2$, $(C_2H_5O)_4Si$, and $(C_2H_5O)_3Si—O—Si(OC_2H_5)_3$. However, the silane compound is not limited to the above examples.

The silane compounds represented by general formulas (II-1) to (II-3) can be used singly or in a combination of two or more silane compounds.

The silane compound preferably contains the compound represented by general formula (II-1) singly or in an amount larger than those of other components.

Perfluoropolyether-Polysiloxane Copolymer Modified Silane Represented by General Formula (III)

[Chemical 11]

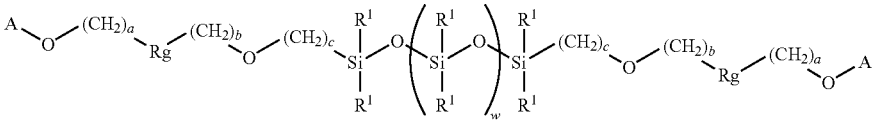

(III)

-continued

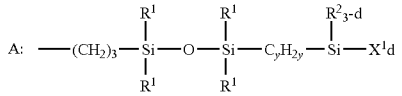

In general formula (III), the Rg group is a divalent group which includes repeating unit represented by formula —($C_jF_{2j}O$)— (wherein j is an integer of 1 to 5 and preferably 1 to 3, and the sequence of $C_jF_{2j}O$ in general formula (III) is random) and has an unbranched straight chain perfluoropolyalkylene ether structure. The repeating unit count is 30 to 60 (preferably 30 to 50). Different j repetition counts may be simultaneously included:

wherein Rg represents a divalent straight chain perfluoropolyether group and include perfluoropolyether groups having a variety of chain lengths. Rg preferably represents a divalent straight chain perfluoropolyether having a perfluoropolyether having about 1 to 5 carbon atoms as the repeating unit. Examples of this divalent straight chain perfluoropolyether are as follows:

$$—CF_2CF_2O(CF_2CFCF_2O)_kCF_2CF_2—$$

$$—CF_2(OC_2F_4)_p—(OCF_2)_q—$$

wherein k, p, and q each represent an integer of 1 or more, and k and p+q preferably fall within the range of 30 to 60. Note the perfluoropolyether molecular structure is not limited to the exemplified structures.

In general formula (III), $R^1$ represents an alkyl group (e.g., a methyl group, ethyl group, propyl group, or butyl group) or phenyl group having 1 to 4 carbon atoms. The alkyl groups or phenyl groups may be the same or different.

In general formula (III), w is 30 to 100 and preferably 30 to 60, and a, b, and c each independently represent an integer of 1 to 5 and preferably 1 to 3.

In general formula (III), $R^2$ represents an alkyl group (e.g., a methyl group, ethyl group, propyl group, or butyl group) or phenyl group having 1 to 4 carbon atoms.

In general formula (III), $X^1$ represents a hydrolyzable group. Examples of $X^1$ include an alkoxy group such as a methoxy group, ethoxy group, propoxy group, or butoxy group; an alkoxyalkoxy group such as a methoxymethoxy group, methoxyethoxy group, or ethoxyethoxy group; alkenyloxy group such as an allyloxy group or isopropenoxy group; an acyloxy group such as an acetoxy group, propionyloxy group, butylcarbonyloxy group, or benzoyloxy group; a ketoxime group such as a dimethylketoxime group, methylethylketoxime group, diethylketoxime group, cyclopentanoxime group, or cyclohexanoxime group; an amino group such as an N-methylamino group, N-ethylamino group, N-propylamino group, N-butylamino group, N,N-dimethylamino group, N,N-diethylamino group, or N-cyclohexylamino group; an amide group such as an N-methylacetoamide group, N-ethylacetoamide group, or N-methylbenzamide group; and an aminooxy group such as an N,N-dimethylaminooxy group or N,N-diethylaminooxy group.

Among them all, the methoxy group, ethoxy group, and isopropynoxy group are preferable.

In general formula (III), d is 2 or 3 and preferably 3 in consideration of hydrolysis, condensation reactivity, and film bonding property, and y is an integer of 1 to 5 and preferably 1 to 3.

The compounds represented by general formula (III) can be used singly or in a combination of two or more compounds.

The material of the plastic base member used in the present invention is not limited to a specific material. Examples of the plastic base member include a methyl methacrylate homopolymer, a copolymer formed from methyl methacrylate and at least another monomer, a homopolymer made from diethylene glycol bisallylcarbonate, a copolymer formed from diethylene glycol bis(allyl carbonate) and at least another monomer, a sulfur-containing copolymer, a halogen copolymer, and a polymer using as a material a compound including polycarbonate, polystyrene, polyvinyl chloride, unsaturated polyester, polyethylene terephthalate, polyurethane, polythiourethane, or epithio group.

Examples of the compound having the epithio group include chain organic compounds such as bis(β-epithiopropylthio)methane, 1,2-bis(β-epithiopropylthio)ethane, 1,3-bis(β-epithiopropylthio)propane, 1-2-(β-epithiopropylthio)propane, 1-(β-epithiopropylthio)-2-(β-epithiopropylthio)propane, 1,4-bis(β-epithiopropylthio)butane, 1,3-bis(β-epithiopropylthio)butane, 1-(β-epithiopropylthio)-3-(β-epithiopropylthiomethyl)butane, 1,5-bis(β-epithiopropylthio)pentane, 1-(β-epithiopropylthio)-4-(β-epithiopropylthiomethyl)pentane, 1,6-bis(β-epithiopropylthio)hexane, 1-(β-epithiopropylthio)-5-(β-epithiopropylthiomethyl)hexane, 1-(β-epithiopropylthio)-2-[(2-β-epithiopropylthioethyl)thio]ethane, and 1-(β-epithiopropylthio)-2-[[2-(2-β-epithiopropylthioethyl)thioethyl]thio]ethane. Examples of the compound having the epithio group also include branched organic compounds and compounds obtained by substituting at least one hydrogen of the episulfide group of each of these compounds with a methyl group. Specific examples of the branched organic compounds include tetrakis(β-epithiopropylthiomethyl)methane, 1,1,1-tris(β-epithiopropylthiomethyl)propane, 1,5-bis(β-epithiopropylthio)-2-(β-epithiopropylthiomethyl)-3-thiapentane, 1,5-bis(β-epithiopropylthio)-2,4-bis(β-epithiopropylthiomethyl)-3-thiopentane, 1-(β-epithiopropylthio)-2,2-bis(β-epithiopropylthiomethyl)-4-thiahexane, 1,5,6-tris(β-epithiopropylthio)-4-(β-epithiopropylthiomethyl)-3-thiahexane, 1,8-bis(β-epithiopropylthio)-4-(β-epithiopropylthiomethyl)-3,6-dithiaoctane, 1,8-bis(β-epithiopropylthio)-4,5-bis(β-epithiopropylthiomethyl)-3,6-dithiaoctane, 1,8-bis(β-epithiopropylthio)-4,4-bis(β-epithiopropylthiomethyl)-3,6-dithiaoctane, 1,8-bis(β-epithiopropylthio)-2,4,5-tris(β-epithiopropylthiomethyl)-3,6-dithiaoctane, 1,8-bis(β-epithiopropylthio)-2,5-bis(β-epithiopropylthiomethyl)-3,6-dithiaoctane, 1,9-bis(β-epithiopropylthio)-5-(β-epithiopropylthiomethyl)-5-[(2-β-epithiopropylthioethyl)thiomethyl]-3,7-dithianonane, 1,10-bis(β-epithiopropylthio)-5,6-bis[(2-β-epithiopropylthioethyl)thio]-3,6,9-trithiadecane, 1,11-bis(β-epithiopropylthio)-4,8-bis(β-epithiopropylthiomethyl)-3,6,9-trithiaundecane, 1,11-bis(β-epithiopropylthio)-5,7-bis(β-epithiopropylthiomethyl)-3,6,9-trithiaundecane, 1,11-bis(β-epithiopropylthio)-5,7-[(2-β-epithiopropylthioethyl)thiomethyl]-3,6,9-trithiaundecane, and 1,11-bis(β-epithiopropylthio)-4,7-bis(β-epithiopropylthiomethyl)-3,6,9-trithiaundecane. Examples of the compound having the epithio group further include alicyclic organic compounds and compounds obtained by substituting at least one hydrogen of the episulfide group of each of these compounds with a methyl group, and aromatic organic compounds and compounds obtained by substituting at least one hydrogen of the episulfide group of each of these compounds with a methyl group. Specific examples of the alicyclic organic compound include 1,3- and 1,4-bis(β-epithiopropylthio)cyclohexane, 1,3- and 1,4-bis(β-epithiopropylthiomethyl)cyclohexane, bis[4-(β-epithiopropylthio)cyclohexyl]methane, 2,2-bis[4-(β-epithiopropylthio)cyclohexyl]propane, bis[4-(β-epithiopropylthio)cyclohexyl]sulfide, 2,5-bis(β-epithiopropylthiomethyl)-1,4-dithiane, and 2,5-bis(β-epithiopropylthioethylthiomethyl)-1,4-dithiane. Specific examples of the aromatic organic compound include 1,3- and 1,4-bis(β-epithiopropylthio)benzene, 1,3- and 1,4-bis(β-epithiopropylthiomethyl)benzene, bis[4-(β-epithiopropylthio)phenyl]methane, 2,2-bis[4-(β-epithiopropylthio)phenyl]propane, bis[4-(β-epithiopropylthio)phenyl]sulfide, bis[4-(β-epithiopropylthio)phenyl)sulfone, and 4,4'-bis(β-epithiopropylthio)biphenyl.

The spectacle lens according to the present invention may have a cured layer between the plastic base material and the underlying layer. To form a cured layer, a composition made from metal oxide colloidal particles and an organosilicon compound represented by general formula (k) below is used.

$$(R^{13})a(R^{14})bSi(OR^{15})_{4-(a+b)} \quad (k)$$

In general formula (k), $R^{13}$ and $R^{14}$ each independently represent an organic group selected from the group consisting of an alkyl group having 1 to 8 carbon atoms, alkenyl group having 2 to 8 carbon atoms, aryl group having 6 to 8 carbon atoms, acyl group having 1 to 8 carbon atoms, halogen group, glycidoxy group, epoxy group, amino group, phenyl group, mercapto group, methacryloxy group, and cyano group. $R^{14}$ represents an organic group selected from the group consisting of an alkyl group having 1 to 8 carbon atoms, acyl group having 1 to 8 carbon atoms, and phenyl group having 6 to 8 carbon atoms, and a and b each independently represent an integer of 0 or 1.

Examples of the metal oxide colloidal particles include tungsten oxide ($WO_3$), zinc oxide (ZnO), silicon oxide ($SiO_2$), aluminum oxide ($Al_2O_3$), titanium oxide ($TiO_2$), zirconium oxide ($ZrO_2$), tin oxide ($SnO_2$), beryllium oxide (BeO), and antimony oxide ($Sb_2O_5$). The metal oxide colloidal particles can be used singly and in combination of two or more types.

A conventional method can be used to prepare a coating solution for a cured layer. A curing catalyst or a variety of organic solvents and surfactants to improve wettability at the time of coating and improve smoothness of a cured layer can be contained in a coating solution as needed. In addition, an ultraviolet absorber, antioxidant, light stabilizer, and antiaging agent can be added unless they affect the coating composition and the physical properties of the curing film.

The coating composition is cured with hot air drying or active energy beam irradiation. The coating composition is cured in hot air of preferably 70 to 200° C. and most preferably 90 to 150° C. An example of the active energy beam is far-infrared radiation which minimizes heat damage.

As a method of forming a cured layer of a coating composition on a base material, a method of coating the base material with the coating composition is available. Examples of the coating means are conventional methods such as dipping, spin coating, and spraying. Dipping or spin coating is most preferable in view of surface precision.

The surface of the cured layer may undergo an ionized gas process in order to ensure the tight contact between the plastic base material and the underlying layer and uniform the initial state of film formation. Oxygen, argon (Ar) or the like can be used as the ionized gas in the ion gun preprocess. A preferable output range includes an acceleration voltage of 50 to 700 V and an acceleration current of 50 to 250 mA from the viewpoint of good tight contact and good wear resistance.

It is not denied to form a primer layer made of an organic compound between the plastic base material and the antireflection film layer, as described in Japanese Patent Laid-Open No. 63-141001. A primer layer may be formed between the plastic base material and the multilayered antireflection film layer 42 or between the plastic base material and the cured layer.

An example of the primer layer is a urethane-based film using polyisocyanate and polyol as materials. Examples of the polyisocyanate include an aduct obtained by bonding several molecules of hexamethylene diisocyanate, 4,4-cyclohexylmethane diisocyanate, or water-added xylene diisocyanate in accordance with a variety of methods, and forming an isocyanurate, allophanate, biuret, or carbodiimide block using acetoacetic acid, malonic acid, or methyl ethyl ketoxime. Examples of the polyol include polyester having a plurality of hydroxyl groups in one molecule, polyether, polycaprolactone, polycarbonate, and polyacrylate. A primer layer may contain metal oxide particles such as fine titanium oxide particles in order to increase the refractive index of the primer layer.

In particular, a primer layer can be formed on a plastic base material having a refractive index of about 1.68 to 1.76 and containing as a material a compound having an epithio group, and the multilayered antireflection film layer 42 of the present invention can be formed on the primer layer. This makes it possible to obtain a spectacle lens excellent in impact resistance, contact, and resistance to marring even if the central thickness of the lens base material is made small.

A plastic spectacle lens obtained by forming a hard coat, antireflection coat, and water-repellent coat on a material having a refractive index (ne) of 1.60 was held by the holding method of this example. A load was applied to the spectacle lens measured when each lens was removed from each holder. A leap tape (leap 3 available from Sumitomo 3M) was used for comparative examples in place of an elastic member. The remaining conditions of the comparative examples are the same as in the example. The blanks were edged to obtain edged lenses in both the example and the comparative examples. The edged lenses were visually tested to determine the presence/absence of axial deviations and coat film damages (cracks).

Measuring Apparatus

Tensile load measuring tool (9500 series available form AIKOH)

(Measuring Method)

1. The adhesion surfaces of a lens and a lens holder are cleaned with acetone to remove foreign substances and oils from the surfaces before each test.

2. The lens holder is mounted at the optical center of the lens and parallel to the optical axis of the lens. The lens is then mounted and kept held in the lens holder for 5 min.

3. The tensile load measuring tool is hooked at its position spaced apart from the lens by 8 mm.

4. The tensile load measuring tool is pulled in a direction perpendicular to the optical axis of the lens.

5. An instantaneous load (N) at which the lens is removed from the lens holder is measured as a maximum load.

(Lens)

Product name of test sample: HOYA Hilux 1.6, Hi-vision with VP coating (single-vision plastic lens)

Average power: −8.00 to +4.00 (diameter: 65 to 75 mm)

Convex surface curve (conversion at refractive index of 1.530): curve 2 to curve 6.50

(Lens Holder and Holding Portion Shape of Elastic Member)

Two types of lens holders used in the comparative examples are shown in Table 1 (note that conversion of the curve and radius of curvature was performed at refractive index of 1.530).

TABLE 1

| | Curve of Holder | Radius of Curvature of Holder | Corresponding Lens Curve |
|---|---|---|---|
| Comparative Example 1 | curve 4 | 133 | curve 5 or less |
| Comparative Example 2 | Curve 7 | 76 | 5 to 8 |

The results of the example and the comparative examples are shown in Table 2.

TABLE 2

| Maximum Load until Removal (unit: N) | | | | |
|---|---|---|---|---|
| | Convex | Maximum Load | | |
| Transmission Power | Surface Curve | Comparative Example 1 | Comparative Example 2 | Example |
| −8.00 | 2.00 | 20.81 | 15.67 | 33.12 |
| 0.00 | 4.50 | 19.85 | 16.27 | 23.89 |
| 1.00 | 5.25 | 18.89 | 19.86 | 37.97 |
| 4.00 | 6.50 | 13.39 | 22.51 | 25.03 |

Table 3 shows the evaluation of the results in Table 2 in accordance with the following grades.

○ 19 or more: removed with a considerable force (passed the upper limit of processing load)→accepted Δ15 to 19: removed with a small force (near the upper limit of processing load)→grade between accepted and rejected products x 15 or less: removed easily→rejected

TABLE 3

| | Convex | Maximum Load | | |
|---|---|---|---|---|
| Transmission Power | Surface Curve | Comparative Example 1 | Comparative Example 2 | Example |
| −8.00 | 2.00 | ○ | Δ | ○ |
| 0.00 | 4.50 | ○ | Δ | ○ |
| 1.00 | 5.25 | Δ | ○ | ○ |
| 4.00 | 6.50 | X | ○ | ○ |

From Table 3, the example of the present invention can obtain a sufficient holding force standing against the processing load in all curves (all types of lenses). The lens holders used in the comparative examples are lack of holding forces for some curves. A plurality of types of holders must be used for lenses of all curves to complement each other in the comparative examples. No axial deviations occurred in the samples represented by ○ of Table 3 upon edging, but axial deviations occurred in all the samples represented by Δ and x of Table 3.

In this manner, according to the present invention, the contact area of the processing target lens with the lens holding surface of the elastic member enlarges to provide a large lens holding force. Thus, axial deviation of the processing target lens caused by the processing resistance during edging can be prevented.

According to this embodiment, the lens holder 8 includes the metal holder main body 12 and the elastic member 14 which is attached to the holder main body 12 to be movable forward/backward. The lens holder 8 is provided with the gap g when the processing target lens 7 is not held. In the gap g, that portion of the rear surface of the lens holding portion 14B which is in the vicinity z of the connecting portion with respect to the fitting shaft portion 14A is brought into contact with the front surface 18 of the holder main body 12, and the remaining portion of the rear surface is spaced apart from the front surface 18. Thus, the gap g enlarges gradually from the vicinity z of the connecting portion toward the outer circumferential edge of the lens holding portion 14B. When holding the processing target lens 7 with the lens holder 8, the lens holding portion 14B is urged against the processing target lens 7 through the leap tape 35, so the lens holding portion 14B elastically deforms toward the rear surface. Even if the curvature of the lens holding surface 24 of the lens holding portion 14B does not coincide with the lens curve of the processing target lens 7, the gap g allows the lens holding portion 14B to deform elastically, so the lens holding surface 24 can be brought into good contact with the convex optical surface 7*a* of the processing target lens 7 through the leap tape 35. As a result, a large contact area and large lens holding force can be obtained. During edging, the processing target lens 7 rarely deviates axially due to the processing resistance and can be edged at high accuracy.

According to this embodiment, a plurality of projections are radially formed on each of the front surface of the holder main body and the rear surface of the lens holding portions such that the projections on the former mesh with the projections on the latter. Thus, the elastic member will not move or rotate due to the processing resistance, and axial deviation of the processing target lens can be prevented more reliably.

According to this embodiment, the projection has a V-shaped cross section having two slopes inclined at almost the same angle. Also, the gap between the front surface of the holder main body and the rear surface of the lens holding portion gradually enlarges from the inner end toward the outer end of the projection. Thus, when the lens holding portion is urged against the processing target lens, the lens holding portion deforms elastically on its outer end side toward the rear surface about the inner end side of the projection as the fulcrum, so that the lens holding surface is brought into tight contact with the processing target lens.

INDUSTRIAL APPLICABILITY

The present invention can be applied to not only a minus-power lens but also a plus-power lens as the processing target lens 7.

The invention claimed is:

1. A lens holder which holds a processing center portion of one optical surface of a processing target lens and is to be mounted on a lens holding shaft of an edging apparatus, said lens holder comprising a metal holder main body and an elastic member which is detachably attached to said holder main body and holds the processing center portion of the processing target lens, said holder main body having a fitting hole formed at a center of a front surface, and said elastic member including a fitting shaft portion to be slidably fitted in the fitting hole, and a lens holding portion integrally provided with the fitting shaft portion and having a size substantially the same as that of the front surface of said holder main body, and the lens holding portion having a rear surface which forms a gap with the front surface, such that a vicinity of a connecting portion with the fitting shaft portion is in contact with the front surface of said holder main body, the gap enlarging gradually from the vicinity of the connecting portion toward an outer circumferential edge of said lens holding portion, wherein when the processing target lens is urged against the lens holder, the lens holding portion of the elastic member undergoes an elastic deformation to an extent of the gap formed between the rear surface of the elastic member and the front surface of the holder main body to thereby come into a substantially stable contact with the optical surface of the processing target lens.

2. A lens holder according to claim 1, wherein said holder main body is provided with a plurality of projections radially on the front surface thereof, and said lens holding portion is provided with a plurality of projections radially on a rear surface thereof, the plurality of projections on the front surface of said holder main body meshing with the plurality of projections on the rear surface of said lens holding portion.

3. A lens holder according to claim 2, wherein each of the projections comprises a projection with a V-shaped cross section having two slopes inclined at almost the same angle, and the gap between the front surface of said holder main body and the rear surface of said lens holding portion is formed to gradually enlarge from an inner end toward an outer end of the projection.

* * * * *